US010647559B2

(12) United States Patent
Schwarz et al.

(10) Patent No.: US 10,647,559 B2
(45) Date of Patent: May 12, 2020

(54) FORK INTEGRATED PALLET CLAMP

(71) Applicant: Crown Equipment Corporation, New Bremen, OH (US)

(72) Inventors: Sebastian Schwarz, Munich (DE); Martin Okroy, Munich (DE)

(73) Assignee: Crown Equipment Corporation, New Bremen, OH (US)

( * ) Notice: Subject to any disclaimer, the term of this patent is extended or adjusted under 35 U.S.C. 154(b) by 97 days.

(21) Appl. No.: 15/988,267

(22) Filed: May 24, 2018

(65) Prior Publication Data

US 2019/0359459 A1 Nov. 28, 2019

(51) Int. Cl.

*B66F 9/18* (2006.01)
*B66F 9/07* (2006.01)
*B66F 9/14* (2006.01)

(52) U.S. Cl.

CPC ..... *B66F 9/185* (2013.01); *B66F 9/07* (2013.01); *B66F 9/147* (2013.01)

(58) Field of Classification Search

CPC .. B66F 9/185; B66F 9/18; B66F 9/188; B62B 2203/29

See application file for complete search history.

(56) References Cited

U.S. PATENT DOCUMENTS 2,211,499 A * 8/1940 Fontaine ..... B66C 1/24 294/63.1
2,256,454 A 9/1941 Bomar
2,527,103 A 10/1950 Noack et al.
2,620,936 A 12/1952 Abbe
2,983,397 A * 5/1961 Hirschboeck ..... B66F 9/188 414/623
2,989,201 A 6/1961 Hansen
3,002,639 A * 10/1961 Cavanagh ..... B66F 9/188 414/623
3,059,796 A 10/1962 Dansereau (Continued)

FOREIGN PATENT DOCUMENTS

DE 10259704 A1 8/2003
DE 102004038067 A1 3/2005

(Continued)

OTHER PUBLICATIONS

"The SP Order Picker Delivers Clearly Elevated Performance"; High Level Order Picker—SP Series; Sep. 2015; retrieved from https://www.crown.com/en-uk/forklifts/high-level-order-picker-sp.html on Sep. 27, 2018.

(Continued)

*Primary Examiner* — Mark C Hageman
(74) *Attorney, Agent, or Firm* — Stevens & Showalter LLP

(57) ABSTRACT

A materials handling vehicle is provided comprising a pair of forks to be inserted in a longitudinal direction of the forks into a pallet having one or more stringers. A pallet clamp device is provided including first and second operating devices, one mounted in each fork for actuating respective punch members into engagement with an adjacent surface on the pallet. Each operating device comprises a module located within a cavity in one of the forks, the module including an actuator, one of the respective punch members, and a linkage structure connecting the actuator and the respective punch member.

27 Claims, 7 Drawing Sheets

(56) References Cited

U.S. PATENT DOCUMENTS

| | | | | |
|---|---|---|---|---|
| 3,097,009 | A * | 7/1963 | Martin | B66F 9/188 294/63.1 |
| 3,493,137 | A | 2/1970 | Nilsen et al. | |
| 4,423,806 | A | 1/1984 | Ogasawara | |
| 4,941,798 | A * | 7/1990 | Meier | B65H 19/123 294/93 |
| 6,767,175 | B2 | 7/2004 | Fujita et al. | |
| 7,340,971 | B2 | 3/2008 | Carter et al. | |
| 7,448,842 | B2 | 11/2008 | Schonauer | |
| 7,544,037 | B2 | 6/2009 | Haverfield et al. | |
| 9,403,547 | B2 * | 8/2016 | Ellington | B62B 3/06 |
| 9,643,827 | B2 * | 5/2017 | Madron | B66F 9/122 |
| 9,783,400 | B2 | 10/2017 | Wieler | |
| 10,392,160 | B2 * | 8/2019 | Coq | B65D 19/38 |
| 2003/0233963 | A1 | 12/2003 | Fan | |
| 2007/0014654 | A1 | 1/2007 | Haverfield et al. | |
| 2007/0074935 | A1 | 4/2007 | Zahn | |
| 2016/0297655 | A1 * | 10/2016 | Weiss | B62B 3/0612 |

FOREIGN PATENT DOCUMENTS

| | | | |
|---|---|---|---|
| FR | 2843379 | B1 | 10/2006 |
| FR | 2836137 | B1 | 11/2007 |
| FR | 2843378 | B1 | 11/2007 |
| FR | 2843377 | B1 | 12/2011 |
| GB | 2405856 | B | 6/2005 |
| GB | 2405857 | B | 6/2005 |
| GB | 2385312 | B | 2/2006 |
| JP | H08165096 | A | 6/1996 |
| JP | H09012292 | A | 1/1997 |
| JP | H09100096 | A | 4/1997 |
| JP | H10291790 | A | 11/1998 |
| JP | H10316380 | A | 12/1998 |
| JP | 2001058798 | A | 3/2001 |
| JP | 2002338198 | A | 11/2002 |
| JP | 2002338199 | A | 11/2002 |
| JP | 2003048696 | A | 2/2003 |
| JP | 2003095596 | A | 4/2003 |
| JP | 2003182993 | A | 7/2003 |
| JP | 2003182994 | A | 7/2003 |
| JP | 2003182995 | A | 7/2003 |
| JP | 2003206096 | A | 7/2003 |
| JP | 2003212486 | A | 7/2003 |
| JP | 2003238087 | A | 8/2003 |
| JP | 2003238088 | A | 8/2003 |
| JP | 2003252596 | A | 9/2003 |
| JP | 2003252598 | A | 9/2003 |
| JP | 2003252599 | A | 9/2003 |
| JP | 2003261297 | A | 9/2003 |
| JP | 2003261299 | A | 9/2003 |
| JP | 2003267688 | A | 9/2003 |
| JP | 2003341993 | A | 12/2003 |
| JP | 2003341995 | A | 12/2003 |
| JP | 2003341998 | A | 12/2003 |
| JP | 2004189450 | A | 7/2004 |
| JP | 2004196445 | A | 7/2004 |
| JP | 2004231347 | A | 8/2004 |
| JP | 2004244144 | A | 9/2004 |
| JP | 2004269170 | A | 9/2004 |
| JP | 2004269240 | A | 9/2004 |
| JP | 2004277076 | A | 10/2004 |
| JP | 2004277083 | A | 10/2004 |
| JP | 2004277084 | A | 10/2004 |
| JP | 2004277085 | A | 10/2004 |
| JP | 2004277086 | A | 10/2004 |
| JP | 2005053668 | A | 3/2005 |
| JP | 2005075620 | A | 3/2005 |
| JP | 2005314044 | A | 11/2005 |
| JP | 2005350198 | A | 12/2005 |
| JP | 2006001690 | A | 1/2006 |
| JP | 2006021866 | A | 1/2006 |
| JP | 2006027890 | A | 2/2006 |
| JP | 2006036506 | A | 2/2006 |
| JP | 2006044878 | A | 2/2006 |
| JP | 2006082881 | A | 3/2006 |
| JP | 2006082883 | A | 3/2006 |
| JP | 2006103926 | A | 4/2006 |
| JP | 2006143425 | A | 6/2006 |
| JP | 2006168855 | A | 6/2006 |
| JP | 2006240796 | A | 9/2006 |
| JP | 2006240837 | A | 9/2006 |
| JP | 2006248620 | A | 9/2006 |
| JP | 2006256737 | A | 9/2006 |
| JP | 2007091423 | A | 4/2007 |
| JP | 4737497 | B2 | 8/2011 |

OTHER PUBLICATIONS

Guthmuller, Jacques; Extended European Search Report; European Application No. 19176492.7; dated Oct. 25, 2019; European Patent Office; Munich, Germany.

* cited by examiner

FORK INTEGRATED PALLET CLAMP

FIELD OF THE INVENTION

The present invention relates to a materials handling vehicle and, more particularly, to a pallet clamp device associated with forks of such vehicles to secure a pallet on the forks and to thereby prevent shifting and/or tipping of the pallet.

BACKGROUND OF THE INVENTION

A variety of pallet clamps and other pallet locking devices for securing a pallet on the forks of a materials handling truck are known in the prior art, such as in U.S. Pat. Nos. 7,544,037, 7,448,842, and JP10291790.

It is noted that conventional pallet clamps may not always completely fulfill the industry standards requirements for retaining pallets in position on forks for materials handling vehicles. Such industry standards may relate to, for example, requirements for securing different kinds of pallets or other structure against lateral and tilting movement, for example when a worker steps on the pallet/structure. For instance, while existing pallet clamps may meet the requirement of securing a pallet against one direction of lateral and tilting movement, such pallet clamps may not sufficiently restrict movement in one or more other directions.

SUMMARY OF THE INVENTION

In accordance with an aspect of the invention, a materials handling vehicle is provided comprising a pair of forks to be inserted in a longitudinal direction of the forks into a pallet having one or more stringers. A pallet clamp device is provided including at least one operating device located in a respective fork for actuating a punch member into engagement with an adjacent surface on the pallet. The at least one operating device actuates the punch member in substantially linear movement transverse to the longitudinal direction of the forks.

The at least one operating device may be located within a cavity of the respective fork.

The respective fork may include a pair of lateral sides extending in the longitudinal direction, and at least one operating device may be positioned between the lateral sides of the respective fork.

The respective fork may include a guide surface located on one of the lateral sides, and the punch member may be supported for sliding movement through the guide surface.

The respective fork may include upper and lower sides extending in the longitudinal direction, and the at least one operating device may be positioned between the upper and lower sides of the respective fork.

The punch member may be actuated to move toward the other one of the pair of forks for engagement with a stringer of the pallet located between the forks.

The punch member may be actuated to move away from the other one of the pair of forks for engagement with a stringer of the pallet located adjacent to an outer side of the respective fork.

The at least one operating device may comprise a module including an actuator, the punch member, and a linkage structure connecting the actuator and the punch member.

The module may include first and second pivot connections to the respective fork, the first pivot connection may define a pivotal attachment between the actuator and the respective fork.

The linkage structure may comprise a first link having a first end connected to the respective fork at the second pivot connection and a second end connected to an output shaft of the actuator, and the linkage structure may comprise a second link having a first end connected to the first link and a second end connected to the punch member.

The actuator may comprise a linear motor.

The actuator may be coupled to a controller and provides at least one of a force feedback signal and a position feedback signal to the controller for controlling a force applied by the punch member to the pallet surface and/or a position of the punch member relative to the respective fork.

The punch member may comprise an elongated shaft extending through the respective fork, and a punch plate removably positioned on an outer end of the elongated shaft for selectable replacement of the punch plate.

In accordance with another aspect of the invention, a materials handling vehicle is provided comprising a pair of forks to be inserted in a longitudinal direction of the forks into a pallet having one or more stringers. A pallet clamp device is provided including first and second operating devices for actuating a respective punch member into engagement with an adjacent surface on the pallet. Each operating device comprises a module located within a cavity in one of the forks, the module including an actuator, one of the respective punch members, and a linkage structure connecting the actuator and the respective punch member.

Each module may include first and second pivot connections to a respective fork, the first pivot connection may define a pivotal attachment between the actuator and the respective fork, and the second pivot connection may define a pivot attachment between the linkage structure and the respective fork.

The linkage structure may comprise a first link having a first end connected to a respective fork at a pivot connection and a second end connected to an output shaft of the actuator, and the linkage structure may comprise a second link having a first end connected to the first link and a second end connected to the punch member.

The actuator may comprise a linear motor.

Each punch member may comprise an elongated shaft extending through a respective fork, and a punch plate removably positioned on an outer end of the elongated shaft for selectable replacement of the punch plate.

The operating devices may actuate the punch members in substantially linear movement transverse to the longitudinal direction of the forks.

Each actuator may be coupled to a controller and may provide a force feedback signal to the controller for controlling a force applied by the punch member to the pallet surface.

In accordance with a further aspect of the invention, a materials handling vehicle is provided comprising a pair of forks to be inserted in a longitudinal direction of the forks into a pallet having one or more stringers. A pallet clamp device is provided including first and second operating devices, one mounted in each fork for actuating respective punch members into engagement with an adjacent surface on the pallet. The operating devices actuate the respective punch members in substantially linear movement transverse to the longitudinal direction of the forks.

The punch members may be actuated to move toward each other for engagement with a stringer of the pallet located between the forks.

The punch members may be actuated to move away from each other for engagement with respective stringers of the pallet located adjacent outer sides of the forks.

Each actuator may be coupled to a controller and provides at least one of a force feedback signal and a position feedback signal to the controller for controlling a force applied by a respective punch member to the pallet surface and/or a position of a respective punch member relative to a respective fork.

Each actuator may comprise a linear motor.

In accordance with an additional aspect of the invention, a materials handling vehicle is provided comprising a load handling assembly to be inserted in a longitudinal direction of the load handling assembly into a load structure having longitudinally extending load structure surfaces. A pallet clamp device includes at least one operating device located in the load handling assembly for actuating a punch member into engagement with at least one of the load structure surfaces. The operating device comprises a module located within a cavity in the load handling assembly, the module including an actuator, the punch member, and a linkage structure connecting the actuator and the punch member.

A second operating device may be provided comprising a module located within the cavity in the load handling assembly, and the second module may actuate a second punch member into engagement with another one of the load structure surfaces.

The load handling assembly may include a ramp structure extending in a direction away from the punch member for engagement with another one of the load structure surfaces.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that the preferred embodiments may be combined, that other embodiments may be utilized, and that changes may be made without departing from the spirit and scope of the present invention.

Figure 1:
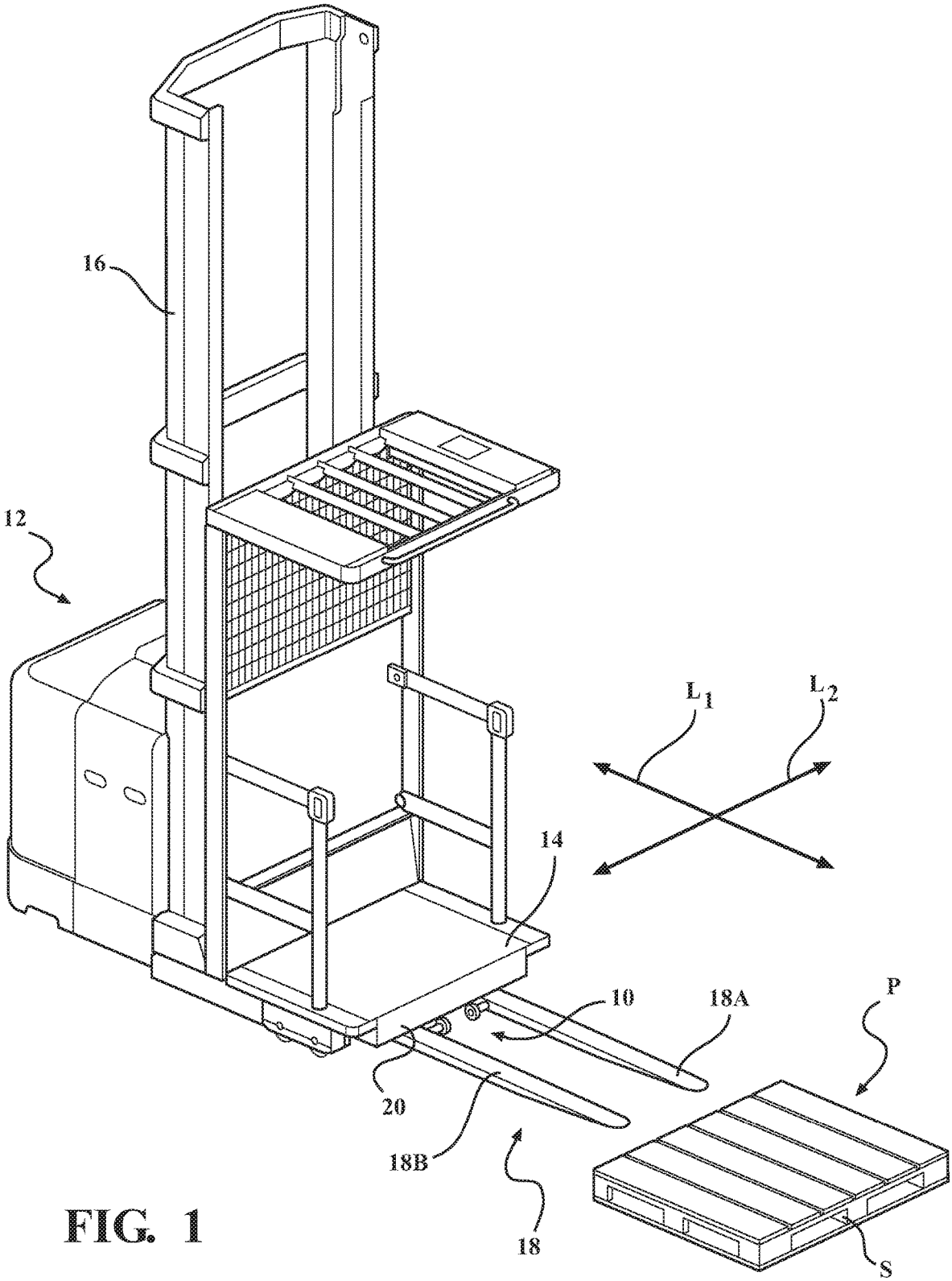
FIG. 1 is a perspective view of a materials handling vehicle including an illustrative embodiment of a pallet clamp device described herein.

Referring initially to FIG. 1, the pallet clamp device of the present application is generally indicated by reference 10, and is illustrated in combination with a materials handling vehicle, more specifically in FIG. 1, a man-up materials handling vehicle 12. The exemplary vehicle 12 shown in FIG. 1 includes an operator platform 14 supported for vertical movement on a mast structure 16 to allow an operator to reach pick items in elevated positions. It is understood that although the pallet clamp device 10 is depicted in combination with a man-up materials handling vehicle 12 to describe advantages associated with the pallet clamp device 10, this description is provided by way of illustration rather than limitation, and a wide variety of materials handling vehicles or similar vehicles may incorporate the pallet clamp device 10 described herein.

A load handling assembly 18 comprising a pair of forks 18A, 18B extends in a longitudinal direction $L_1$, i.e., front to rear, from a base portion 20 of the operator platform 14. A spacing of the forks 18A, 18B in the lateral direction $L_2$, i.e., perpendicular to the longitudinal direction, can be selected to provide support to different pallet types such as, for example, Euro pallets (Europe), GMA pallets (North America), and CHEP pallets (Australia). It may be noted that although the present description is provided with specific reference to providing the pallet clamp device 10 for clamping pallets, the clamping device can operate to clamp a variety of articles or load structures supported on the load handling assembly 18 including, without limitation, pallets, carts, pedestrian platforms, storage racks, or other storage structure. Hence, it should be understood that specific references in the following description to operations performed on pallets are intended to encompass operations performed on alternative structures supported on the forks 18A, 18B. Further, although the following description of the clamping device describes engaging a longitudinally extending stringer or stringers as defining an engaged surface of the structure supported on the forks 18A, 18B, it should be understood that the description of the engaged surface encompasses any suitable structure that includes an area or surface for engagement by the pallet clamp device 10.

Figure 2:
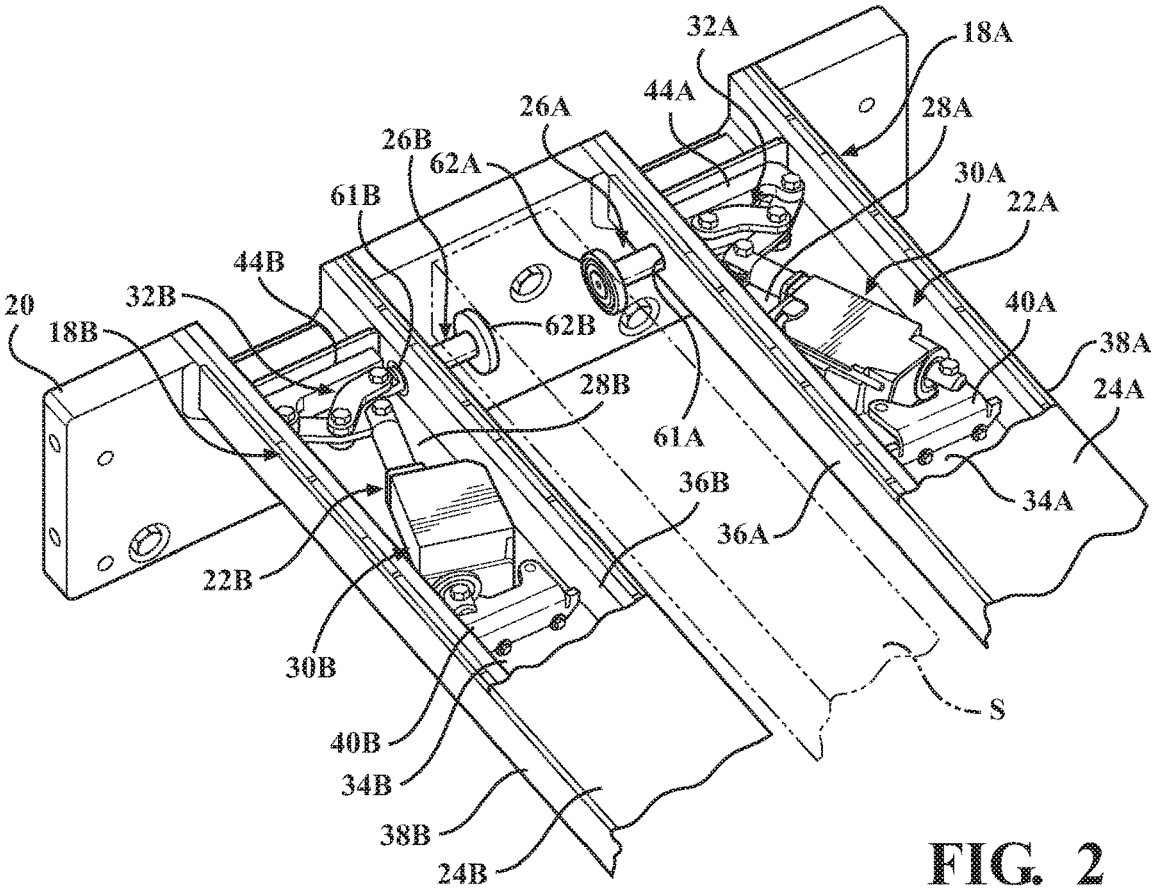
FIG. 2 is perspective view of a portion of a load handling assembly of the materials handling vehicle, partially cut away to show operating devices of the pallet clamp device located in cavities of respective forks.

Referring to FIG. 2, a portion of the forks 18A, 18B adjacent to the base portion 20 of the operator platform 14 is illustrated, and is shown in association with a center stringer S of a pallet, such as when the forks 18A, 18B are inserted longitudinally into a pallet comprising the stringer S. As illustrated herein, the forks 18A, 18B may be located on either side of a center stringer S of a Euro pallet. Further, a portion of the upper side 24A, 24B of each fork 18A, 18B is cut away in FIG. 2 to illustrate the location of first and second operating devices 22A, 22B of the pallet clamp device 10 in relation to the respective forks 18A, 18B. The operating devices 22A, 22B actuate clamp structures comprising punch members 26A, 26B into engagement with respective adjacent surfaces on the pallet, as illustrated in FIG. 2 by the punch members 26A, 26B on either side of the stringer S.

The first operating device 22A is formed as a module located entirely within a first cavity 28A in the fork 18A, and the second operating device 22B is formed as a module located entirely within a second cavity 28B in the fork 18B. Each module formed by the operating devices 22A, 22B includes a respective actuator 30A, 30B, one of the respective punch members 26A, 26B, and a linkage structure 32A, 32B connecting the actuator 30A, 30B and the respective punch member 26A, 26B.

The first cavity 28A in the fork 18A is defined within an area bounded by the upper side 24A, an opposing lower side 34A, an inner lateral side 36A, and an opposing outer lateral side 38A. Similarly, the second cavity 28B in the fork 18B is defined within an area bounded by the upper side 24B, an opposing lower side 34B, an inner lateral side 36B, and an opposing outer lateral side 38B. In an exemplary non-limiting embodiment, the cavities 28A, 28B may define an installation space having dimensions of less than 12.5 in.× 4.5 in.×2 in. (320 mm×116 mm×50 mm) for receiving the operating devices 22A, 22B. It may be understood that the dimensions of the installation space can vary and the installation space can be defined within forks 18A, 18B having dimensions that are smaller or larger than the particular installation space described herein. For example, in additional non-limiting examples, a smaller installation space can be formed within a fork having a relatively smaller cross section, e.g., a fork cross section of 4 in.×1.75 in (100 mm×65 mm), or the installation space may be defined within a fork having a relatively larger cross section, e.g., a fork cross section of 6 in.×3 in. (150 mm×75 mm). As is described in greater detail below, the operating devices 22A, 22B each define a compact module comprising a whole clamping system that can be integrated directly within the cavities 28A, 28B defined in a respective fork 18A, 18B.

Figure 3:
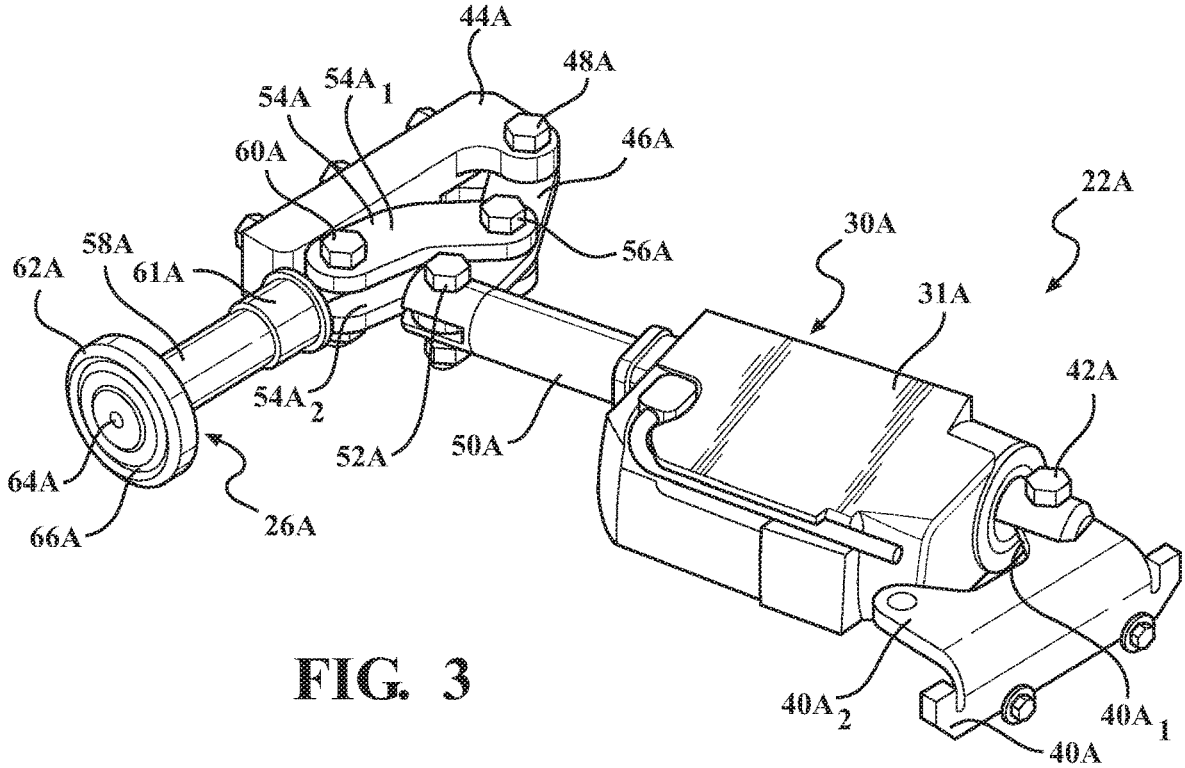
FIG. 3 is an enlarged perspective view of one of the operating devices shown in FIG. 2.

Referring to FIG. 3, the first operating device 22A is described in detail, wherein it may be understood that the second operating device 22B can be formed with the same construction as is described for the first operating device 22A, i.e., the second operating device 22B can be formed as a mirror image of the first operating device 22A.

The first operating device 22A is provided with an actuator mounting bracket 40A rigidly attached to the fork 18A within the first cavity 28A and pivotally connected to a first end of the actuator 30A at a first pivot connection defined by a fastener 42A. The actuator mounting bracket 40A is formed with a first tongue 40$A_1$ and a second tongue 40$A_2$. The first tongue 40$A_1$ can form an attachment location for the actuator 30A of the first operating device 22A, and a second tongue 40$A_2$ can optionally be provided to form an attachment location for the actuator 30B of the second operating device 22B within the second cavity 28B of the fork 18B, see FIG. 2. The second tongue 40$A_2$ can also optionally provide a mounting location for the actuator 30A in an alternative configuration for actuating the punch member 26A in outwards movement, i.e., away from the fork 18B, as is described further below.

The operating device 22A is additionally provided with a linkage mounting bracket 44A rigidly attached to the fork 18A within the first cavity 28A at an opposing end of the operating device 22A from the actuator mounting bracket 40A. A first link 46A of the linkage structure 32A is pivotally connected to the linkage mounting bracket 44A at a second pivot connection defined by a fastener 48A. A second end of the first link 46A is pivotally connected to an output shaft 50A of the actuator 30A by a fastener 52A.

A second link 54A of the linkage structure 30A comprises a link that is shorter than the first link 46A. The second link 54A includes a first end pivotally connected to an approximate midpoint on the first link 46A by a fastener 56A and a second end pivotally connected to an inner end of an elongated shaft 58A of the punch member 26A by a fastener 60A. In the illustrated embodiment, the second link 54A includes first and second link sections 54$A_1$, 54$A_2$ positioned on opposing sides of the first link 46A and positioned on opposing sides of the inner end of the elongated shaft 58A.

The fasteners 42A, 48A, 52A, 56A, 60A forming the above-described pivot connections for the operating device 22A can be a bolt or any equivalent structure, such as a pin, to define a hinge-like pivot connection.

The elongated shaft 58A can be supported for sliding movement through the inner lateral side 36A of the fork 18A by a guide surface defined by a bushing 61A affixed to the inner lateral side 36A of the fork 18A, see FIG. 2. Optionally, a punch plate 62A is removably positioned on an outer end of the elongated shaft 58A, and can be attached to the elongated shaft 58A with a removable fastener, such as by means of a screw 64A recessed below an engagement surface 66A of the punch plate 62A. The removable punch plate 62A enables different punch plates 62A to be selected for various clamping applications. For example, the punch plate 62A may define an engagement surface 66A formed of a hard material, such as steel, for applications involving engagement with pallets or other structures formed of a relatively hard material. The punch plate 62A can be readily replaced with a punch plate 62A having an engagement surface 66A formed of another material, such as a relatively soft or resilient material, e.g., rubber, for other applications such as for engagement with pallets formed of a relatively softer material, such as a plastic material. The illustrated punch plate 62A is formed as a circular member and provides a relatively large surface area for engagement with an adjacent surface of a pallet, thereby providing a secure and stable grip on the pallet. However, other shapes and configurations for the punch plate 62A can be provided including non-circular shapes and/or configurations defining engagement features adapted to match corresponding engagement features of an engaged surface of a pallet.

Figure 4:
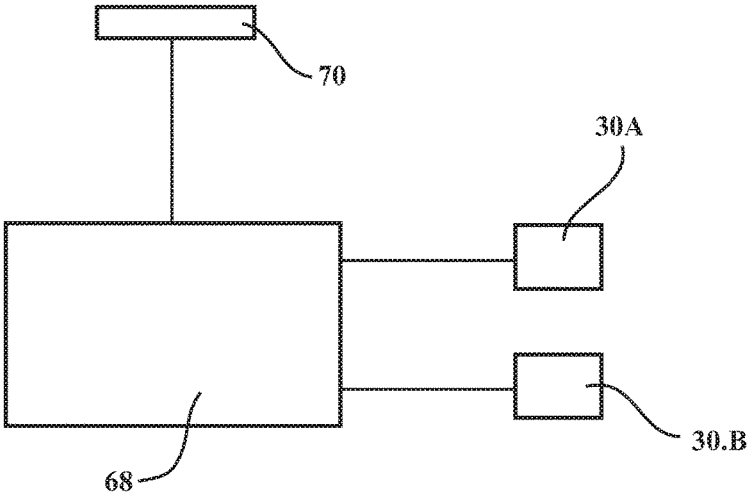
FIG. 4 is a diagrammatic view illustrating a control system for the pallet clamp device.

The actuators 30A, 30B can be electrically actuated linear motors, such as a model LA23 linear actuator, manufactured by LINAK GmbH of Nidda, Germany. Hence, the output shaft 50A of the actuator 30A shown in FIG. 3 is linearly movable relative the actuator body 31A to drive the first link 46A in pivotal movement about the pivot connection defined by the fastener 48A. As depicted in FIG. 4, the actuators 30A, 30B can be connected to a controller 68 of the vehicle 12, wherein the controller 68 can receive an input signal from an operator control panel 70 or other suitable operator control and provide one or more control signals to the actuators 30A, 30B for actuating the first and second operating devices 22A, 22B into and out of engagement with a pallet. The controller 68 can additionally receive force feedback signals and/or position feedback signals from the actuators 30A, 30B that can be processed by software in the controller 68 to detect engagement with the pallet so as to control the distance each punch member 26A, 26B extends, as well as to control a force applied by the punch members 26A, 26B to obtain a predetermined clamping force with the pallet. In an exemplary embodiment, each punch member 26A, 26B may be actuated to move a predetermined distance, e.g., a distance of up to 3.6 in. (90.4 mm) in linear movement and may apply a predetermined force, e.g., a force of up to 2500 N.

Figure 5A:
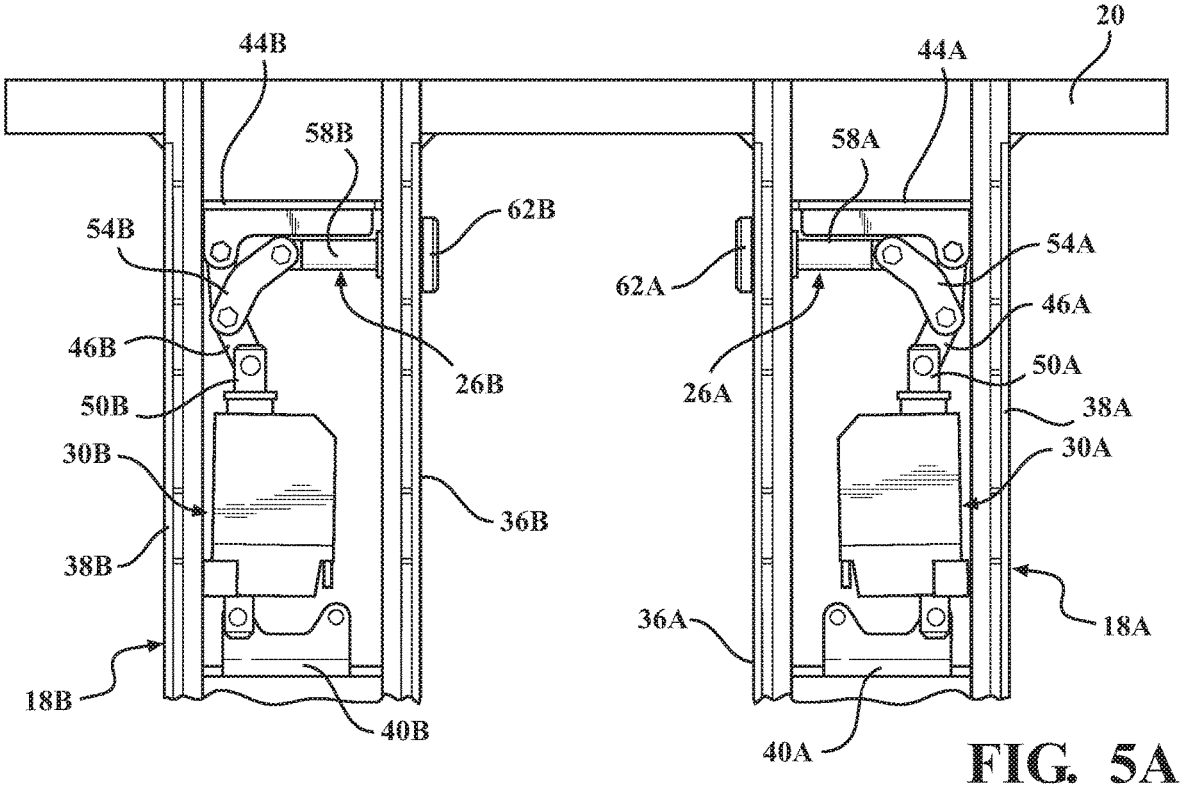
FIG. 5A is a plan view of the pallet clamp device illustrating actuated punch members in a retracted non-clamping position.

An operation of the pallet clamp device 10 is described with reference to FIGS. 5A and 5B. FIG. 5A illustrates the punch members 26A, 26B located in a retracted position with the punch plates 62A, 62B located closely adjacent to or in engagement with the respective inner lateral sides 36A, 36B of the forks 18A, 18B in preparation for receiving a pallet on the forks 18A, 18B. In the retracted position, the output shafts 50A, 50B of the actuators 30A, 30B may be fully retracted, and the first links 46A, 46B may be pivoted to a position adjacent to the respective outer lateral sides 38A, 38B of the forks 18A, 18B.

In response to a signal from the controller 68, the actuators 30A, 30B extend the output shafts 50A, 50B to pivot the first links 46A, 46B toward the respective inner lateral sides 36A, 36B of the forks 18A, 18B. The actuators 30A, 30B pivot relative to the actuator mounting brackets 40A, 40B within the cavities 28A, 28B to accommodate the pivotal movement of the first links 46A, 46B. The pivotal movement of the first links 46A, 46B moves the second end of the second links 54A, 54B toward the linkage mounting brackets 44A, 44B, and the first end of the second links 54A, 54B pushes the elongated shafts 58A, 58B toward an extended position outward from the respective inner lateral sides 36A, 36B of the forks 18A, 18B, as shown in FIG. 5B. The elongated shafts 58A, 58B move in linear or substantially linear paths, transverse to the longitudinal direction $L_1$ of forks 18A, 18B, as they are guided in sliding movement through the bushings 61A, 61B. In the extended position in the illustrated embodiment, the punch plates 62A, 62B are displaced toward each other, inwardly from the forks 18A, 18B, and may be positioned into engagement with opposing sides of a stringer S of the pallet. As noted above, feedback signals from the actuators 30A, 30B to the controller 68 may be used to detect engagement of the punch plates 62A, 62B with the stringer S, such as to control the distance that the punch members 26A, 26B are advanced. Also, the feedback signals to the controller 68 may be used to control the engagement force applied by the punch plates 62A, 62B so as to ensure that the applied engagement force is sufficient to retain the pallet against shifting and/or tilting movement relative to the forks 18A, 18B.

Figure 6:
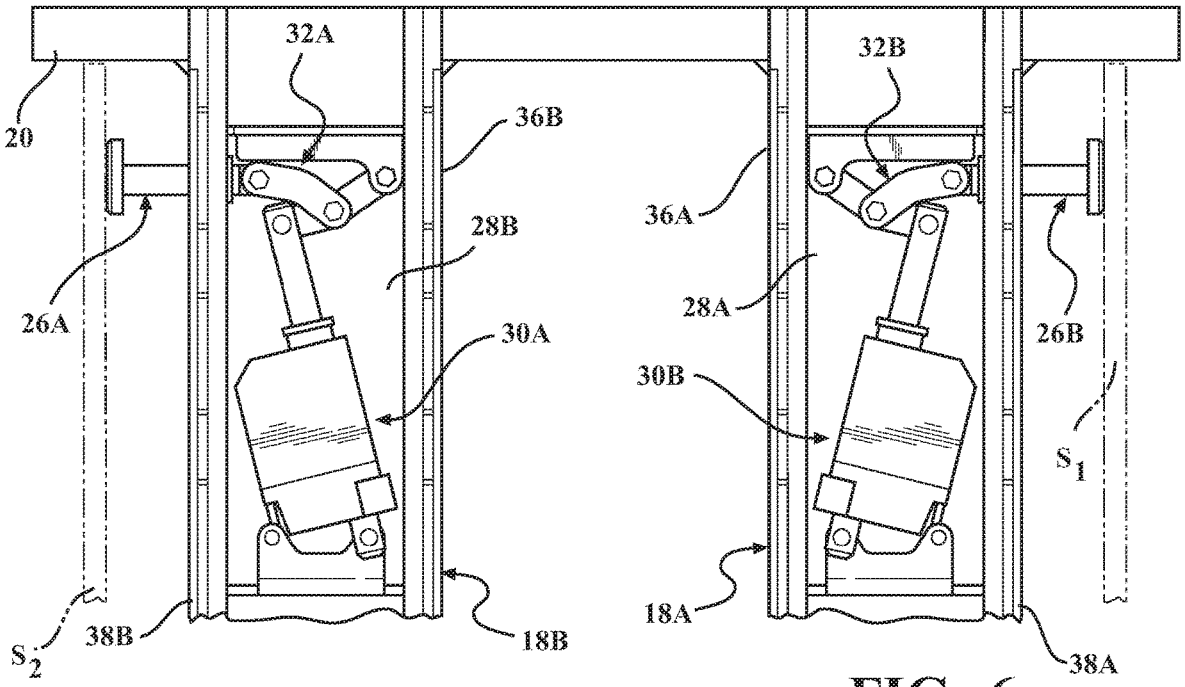
FIG. 6 is a plan view of the pallet clamp device illustrating an additional aspect of the invention with the operating devices positioned to clamp a structure outwardly from the forks.

Referring to FIG. 6, in accordance with an aspect of the invention, the operating devices 22A, 22B may be configured as modules that can be removed and exchanged within the cavities 28A, 28B of the forks 18A, 18B. For example, the operating devices 22A, 22B may be repositioned to enable engagement with outer stringers $S_1$, $S_2$, such as outer stringers of GMA or CHEP pallets, wherein the first operating device 22A may be positioned within the second cavity 28B of the fork 18B, and the second operating device 22B may be positioned within the first cavity 28A of the fork 18A. Alternatively, the first and second operating devices 22A, 22B could be repositioned for engagement with the outer stringers $S_1$, $S_2$ by flipping or rotating the operating devices 22A, 22B within the respective cavities 28A, 28B to orient the punch members 26A, 26B outwardly, extending through the respective outer lateral sides 38A, 38B.

As illustrated in FIG. 6, the punch members 26A, 26B are supported for sliding linear movement through the outer lateral sides 38B, 38A of respective forks 18B, 18A to exert an outwardly directed clamping force on the outer stringers $S_1$, $S_2$. It may be understood that the actuation of the operating devices 22A, 22B between retracted and extended positions in the reconfigured arrangement of FIG. 6 is the same as described above with reference to FIGS. 5A and 5B.

Figure 5B:
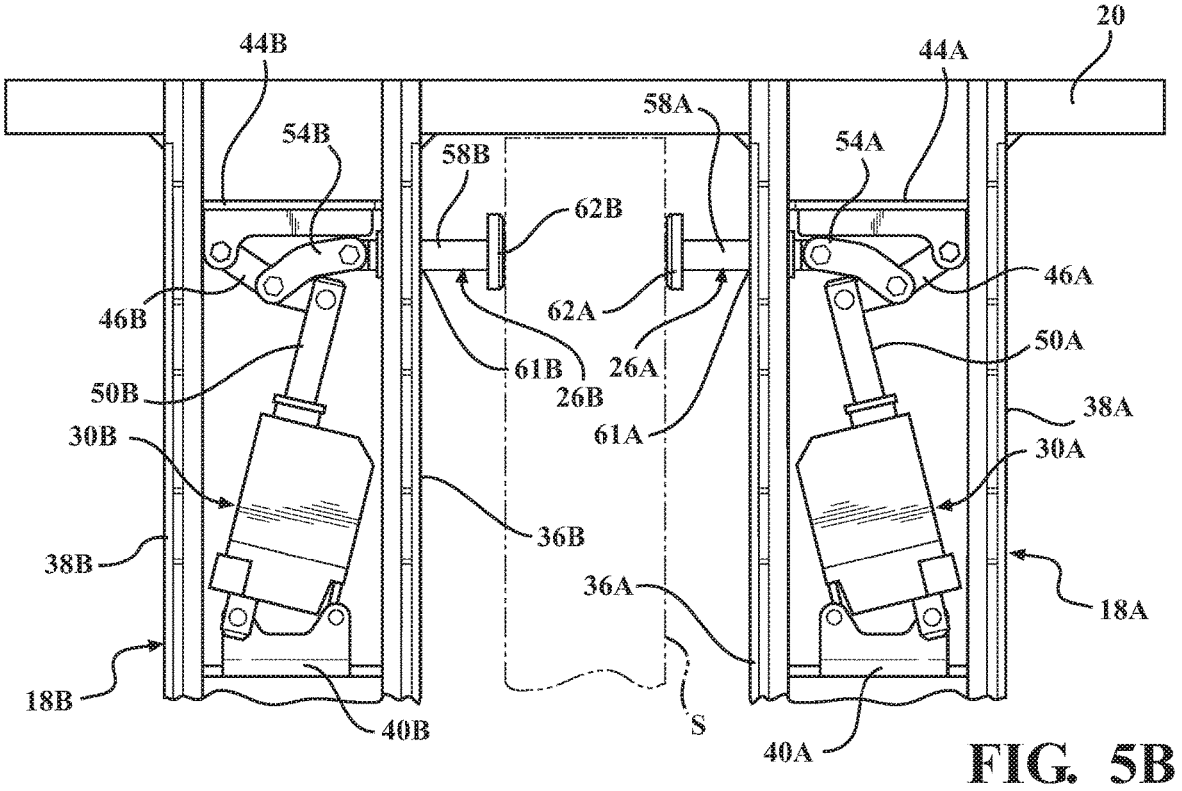
FIG. 5B is a plan view of the pallet clamp device illustrating actuated punch members in an extended clamping position to clamp a structure inwardly of the forks.

It should also be understood that although the retracted and extended positions of the operating devices 22A, 22B are depicted as fully retracted and fully extended positions in FIGS. 5A, 5B, and 6, the retracted and extended positions may be defined as any selected position between the depicted retracted and extended positions, as may be controlled by the actuators 30A, 30B. In particular, the extended position can vary and may be defined by a position at which the punch member 26A, 26B engages an adjacent surface of the pallet, e.g., an adjacent surface defined by a stringer.

While the preferred embodiment for the actuators 30A, 30B is described as electrically actuated linear motors, other actuators may be implemented in the operating devices 22A, 22B including, without limitation, hydraulic or pneumatic actuators to the extent that such alternative actuators can be fully contained within suitably sized cavities 28A, 28B defined within the forks 18A, 18B. Additionally, although the preferred actuation structure is described as a linear actuator 30A, 30B with a linkage structure 32A, 32B for actuating the punch members 26A, 26B in substantially linear movement, actuators having other movements and connected to the punch members 26A, 26B, either directly or indirectly, through a linkage structure or other transmission means may be implemented to actuate the punch members 26A, 26B. For example, in alternative embodiments, the operating devices 22A, 22B may incorporate a linkage structure comprising a direct connection between the actuators 30A, 30B, or alternative actuators, and the punch members 26A, 26B, such as a linkage structure comprising, for example, a push chain.

The modular construction and placement of the operating devices 22A, 22B fully within the forks 18A, 18B can be scaled to different sizes such that the operating devices 22A, 22B may be implemented, for example, in smaller vehicles that may not readily accommodate prior art pallet clamp systems due to space constraints in the area surrounding the forks of the load handling assembly. Further, the aspect of modular operating devices fully contained within the forks 18A, 18B can include provision of a clamp actuation system for clamp structures other than the punch members 26A, 26B described herein. For example, modular operating devices that are the same as or different from the operating devices 22A, 22B can be located in the fork cavities 28A, 28B to actuate clamp structures that move in linear, non-linear, or pivoting movement. Such alternative modular operating devices may operate to move associated clamp structures to predetermined positions inwardly or outwardly from the forks 18A, 18B. Additionally, such alternative modular operating devices may include processing a feedback signal at a controller for determining engagement of a pallet and for controlling a clamping force to a predetermined value and/or controlling a position of a punch member 26A, 26B relative to a respective fork 18A, 18B, as well as to perform other software implemented operations, such as to improve safety and/or contribute to convenience of operation.

Figure 7:
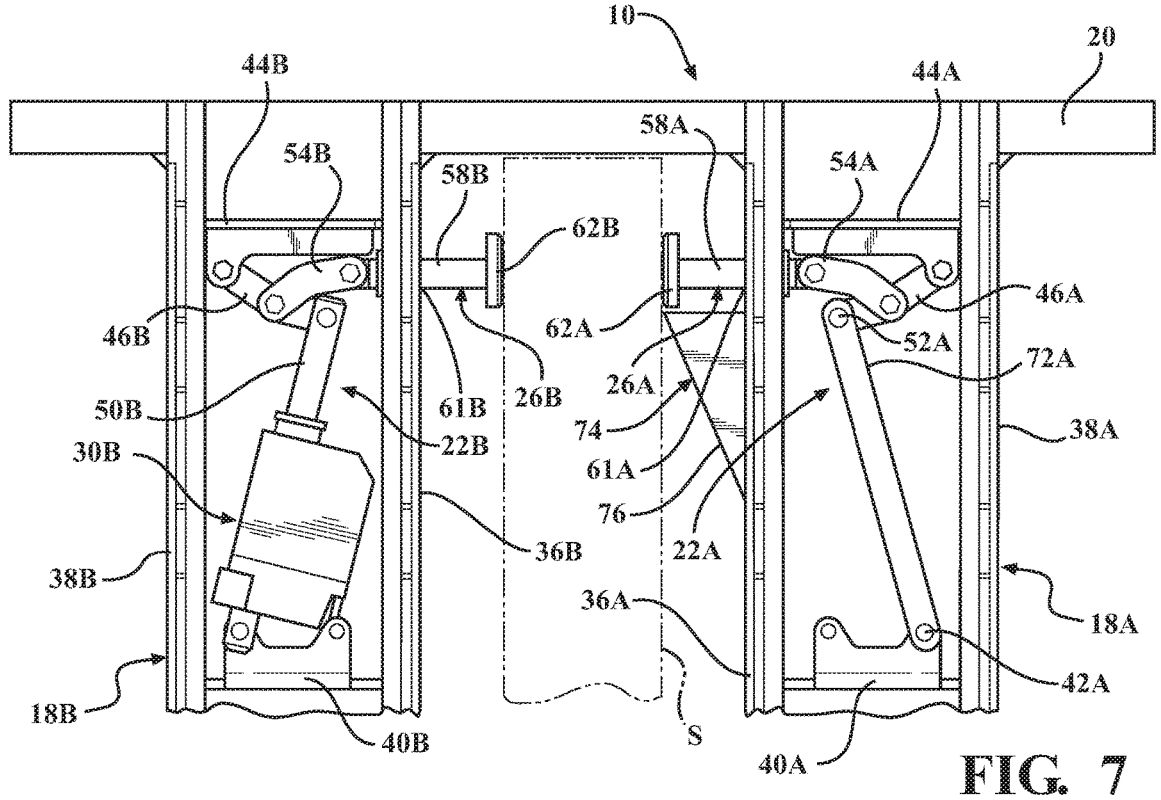
FIG. 7 is a plan view illustrating an alternative configuration of the pallet clamp device for clamping a structure inwardly of the forks, in which a punch member of one of the operating devices is located in a fixed position.
Figure 8:
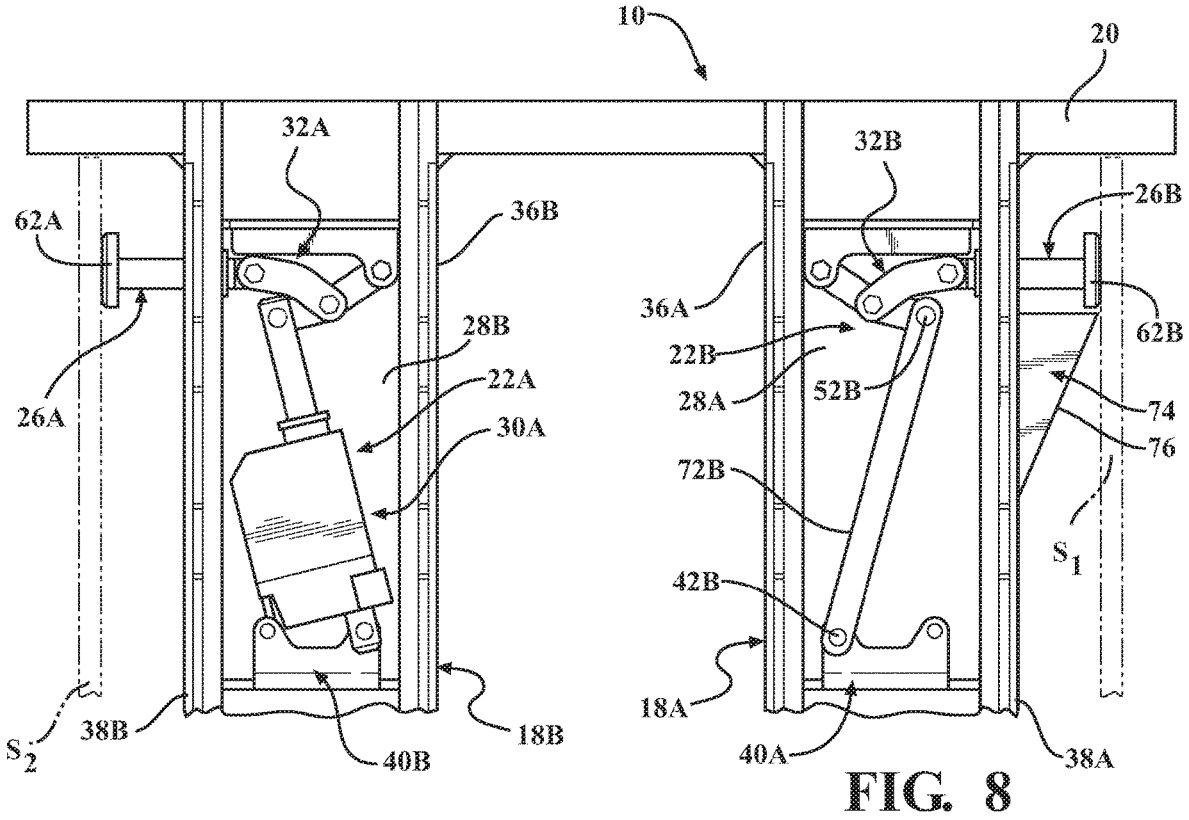
FIG. 8 is a plan view illustrating an alternative configuration of the pallet clamp device for clamping a structure outwardly from the forks, in which a punch member of one of the operating devices is located in a fixed position.

Referring to FIGS. 7 and 8, an alternative configuration for the pallet clamp device 10 is illustrated in which one of the operating devices 22A, 22B is maintained in a fixed position, while the other of the operating devices 22A, 22B remains operable to move a respective punch member 26A, 26B into and out of engagement with a pallet stringer S. For example, as is illustrated in FIG. 7A, the actuator 30A of the operating device 22A has been replaced with a strut 72A. The strut 72A can extend between connection points 42A, 52A at the mounting bracket 40A and second end of the first link 46A, wherein the strut 72A has a fixed length that can define a fixed position for the linkage structure 32A positioning the punch member 26A at a fully extended position, or at any other predetermined position. In addition, a ramp structure 74 may be mounted to the inner lateral side 36A of the fork 18A to guide the forks 18A, 18B and stringer S to a substantially centered position. The ramp structure 74 includes a ramp surface 76 extending at an angle from the inner lateral side 36A of the fork 18A to guide or position the punch plate 62A adjacent to a side of the stringer S as the forks 18A, 18B are moved into association with the stringer S. Subsequently, the operating device 22B can be actuated to an extended position to engage the punch plate 62B of the punch member 26B on the opposing side of the stringer S and apply a force sufficient to bias the stringer S and fixed punch member 26A into engagement with each other.

The alternative pallet clamp device 10, including a fixed punch member 26A, 26B could also be used in the configuration for clamping the outer stringers $S_1$, $S_2$ of a pallet. For example, as illustrated in FIG. 8, the actuator 30B of the operating device 22B has been replaced with a strut 72B extending between opposing connection points 42B, 52B to define a fixed position for the punch member 26B extending outwardly from the outer lateral side 38A of the fork 18A. A ramp structure 74 mounted to the outer lateral side 38A of the fork 18A includes a ramp surface 76 that can operate to guide the fork 18A to a position where the punch plate 62B is adjacent to a side of the stringer $S_1$ as the forks 18A, 18B are moved into association with the stringers $S_1$, $S_2$. Subsequently, the operating device 22A can be actuated to engage the punch plate 62A of the punch member 26A on the stringer $S_1$ and apply a force sufficient to bias the stringer $S_1$ and fixed punch member 26B into engagement with each other. It should be understood that in the alternative configuration illustrated in FIGS. 7 and 8, either of the operating devices 22A, 22B may be modified to define the respective punch member 26A, 26B as a fixed punch member supported on one of the forks 18A, 18B.

Figure 9:
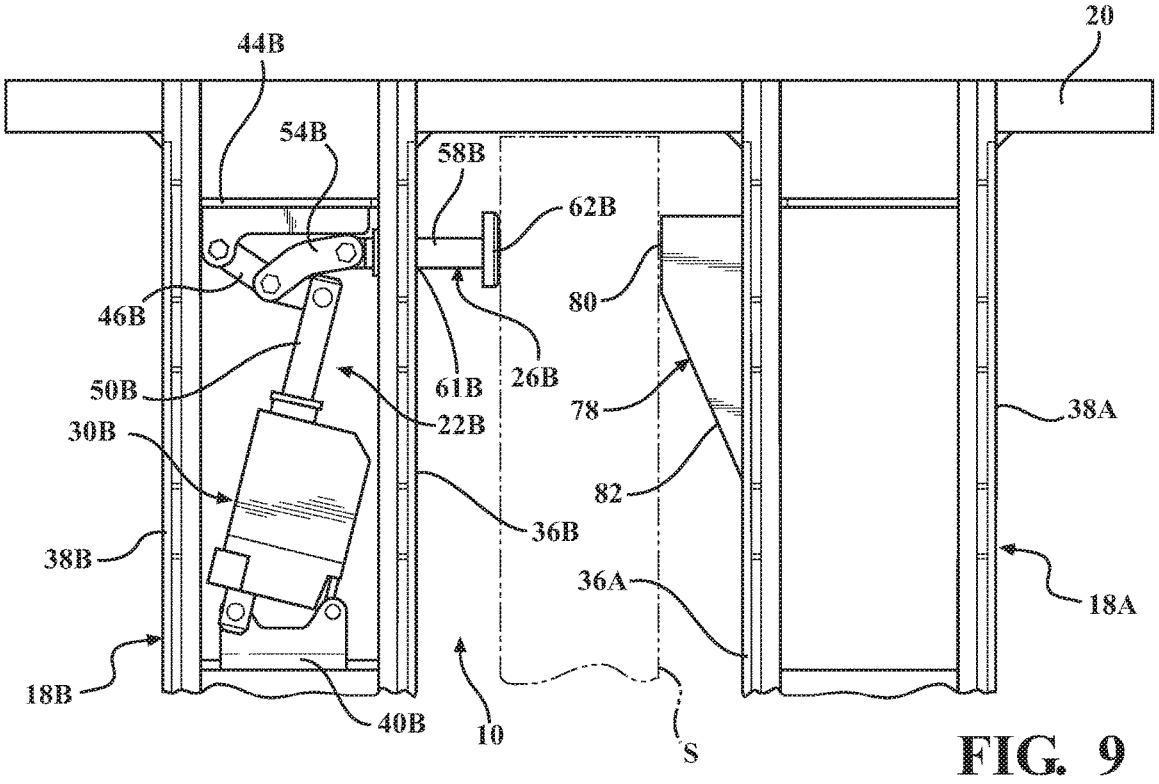
FIG. 9 is a plan view illustrating an alternative configuration of the pallet clamp device for clamping a structure inwardly of the forks, in which one of the operating devices is replaced with a ramp structure.
Figure 10:
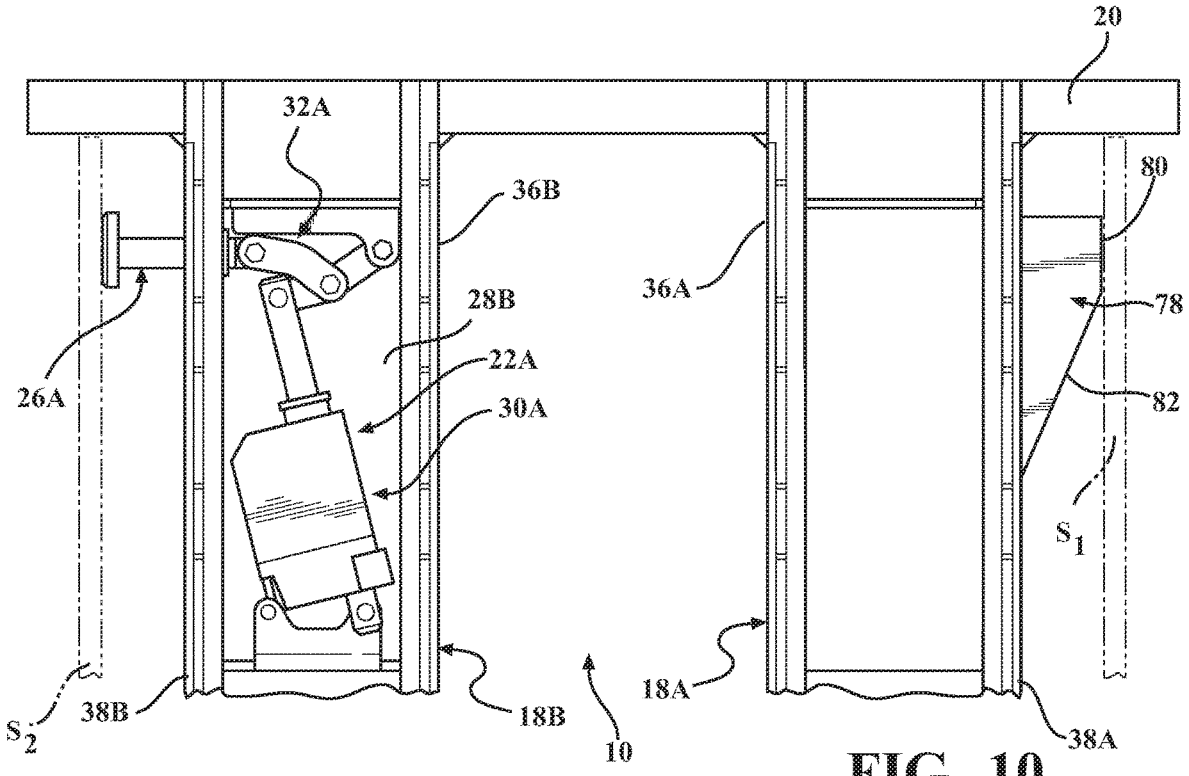
FIG. 10 is a plan view illustrating an alternative configuration of the pallet clamp device for clamping a structure outwardly from the forks, in which one of the operating devices is replaced with a ramp structure.

Referring to FIGS. 9 and 10, a further alternative configuration for providing a pallet clamp device 10 is illustrated in which one of the operating devices 22A, 22B is replaced with a ramp structure 78 defining a fixed clamp surface 80, shown mounted to a side of the fork 18A. As seen in FIG. 9, the ramp structure 78 can be mounted to the inner lateral side 36A of the fork 18A and includes a ramp surface 82 to guide the fork 18A to a position where the clamp surface 80 is adjacent to a side of the stringer S as the forks 18A, 18B are moved into association with the stringer S. Actuation of the operating device 22B can apply a force sufficient to engage the punch plate 62B of the punch member 26B on the opposing side of the stringer S to bias the stringer S and clamp surface 80 into engagement with each other. As seen in FIG. 10, the ramp structure 78 can be mounted to the outer lateral side 38A of the fork 18A, such that the ramp surface 82 positions the clamp surface 80 adjacent to a side of the stringer $S_1$ as the forks 18A, 18B are moved into association with the stringers $S_1$, $S_2$. Actuation of the operating device 22A can engage the punch plate 62A of the punch member 26A on the stringer $S_2$ and apply a force sufficient to bias the stringer $S_1$ and clamp surface 80 into engagement with each other. It should be understood that in the alternative configuration illustrated in FIGS. 9 and 10, either of the operating devices 22A, 22B may be removed and replaced with a clamp surface 80, such as is described in association with the ramp structure 78, supported on one of the forks 18A, 18B.

The alternative configurations provided by either replacing one of the actuators 30A, 30B with a strut 72A, 72B for locating a punch member 26A, 26B at a fixed location, as described with reference to FIGS. 7 and 8, or by replacing one of the operating devices with a fixed clamp surface 80, as described with reference to FIGS. 9 and 10 can provide a cost reduction over the configuration having the operating devices 22A, 22B actuating both punch members 26A, 26B in clamping movement.

Figure 11A:
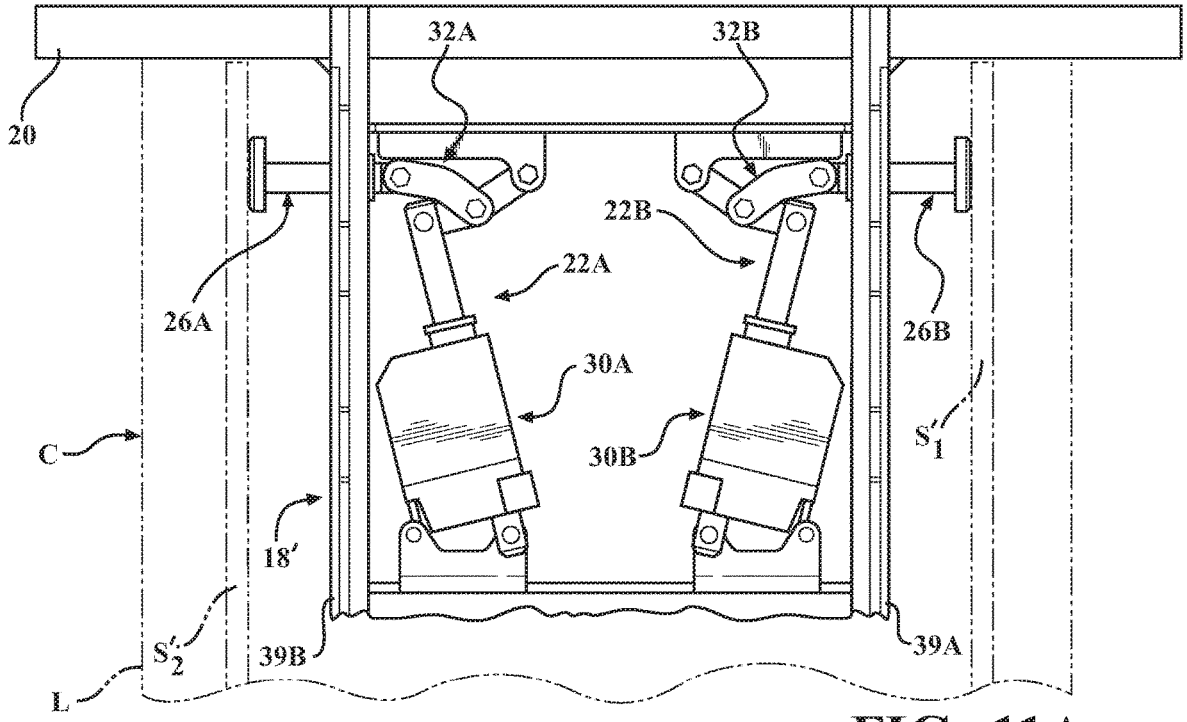
FIG. 11A is a plan view illustrating an alternative configuration for a load handling assembly comprising a single fork and including a clamp device comprising operating devices positioned to clamp a structure outwardly from the single fork.
Figure 11B:
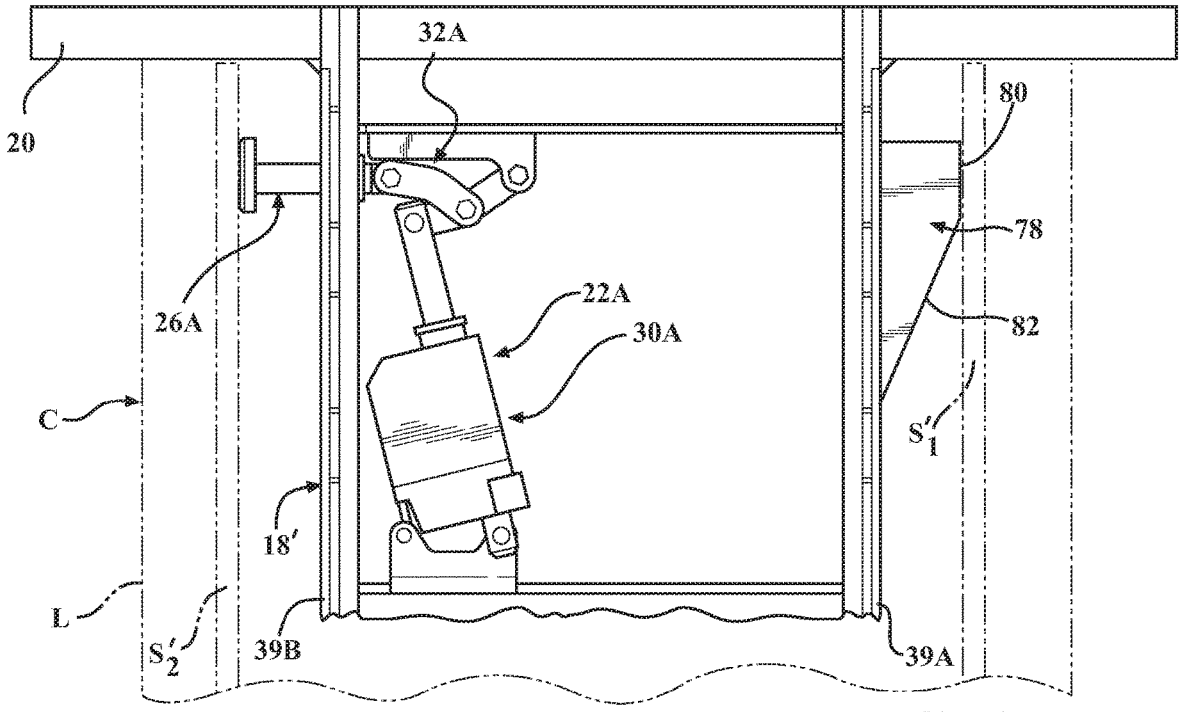
FIG. 11B is a plan view illustrating an alternative configuration for the load handling assembly of FIG. 11A in which one of the operating devices is replaced with a ramp structure.

It should be noted that although the drawings referenced in the preceding description depict pairs of forks 18A, 18B supported at fixed positions, i.e., at different spacings, along the base portion 20 of the operator platform 24, the modular configuration of the operating devices 22A, 22B permits a load handling assembly to be configured with movable forks 18A, 18B that can be located at different lateral positions along the base portion 20. Further, the clamp device may be used with a load handling assembly comprising an alternative fork configuration for engaging load structures. For example, in an alternative configuration of the load handling assembly, as illustrated in FIGS. 11A and 11B, a single fork 18' can be provided for supporting a load structure. The load structure may comprise a cart C, wherein the fork 18' can be moved to a location below a load platform L of the cart C and positioned extending adjacent to longitudinally extending load structure surfaces, such as respective lower sidewalls S1', S2' of the cart C, e.g., longitudinal frame members of the cart C.

As seen in FIG. 11A, the clamp device may comprise the first and second operating devices 22A, 22B located within the single fork 18' of the load handling assembly for actuating the respective punch members 26A, 26B outward into engagement with the lower sidewalls S1', S2' of the cart C. Actuation of the first and second operating devices 22A, 22B within the single fork 18' can be controlled to extend the punch members 26A, 26B from opposing lateral sides 39A, 39B of the single fork 18' into engagement with the lower sidewalls S1', S2' in a manner similar to that described above for actuation of the operating devices 22A, 22B with reference to FIG. 6.

As seen in FIG. 11B, the clamp device may comprise only the first operating device 22A located within the single fork 18' for actuating the punch member 26A extending through the lateral side 39B. The ramp structure 78 described with reference to FIG. 10 can be mounted to the opposing lateral side 39A of the fork 18', such that the ramp surface 82 extends in a direction away from the punch member 26A and the clamp surface 80 can be positioned adjacent to a surface of the sidewall $S_1'$ as the fork 18' is moved into association with the cart C. Actuation of the operating device 22A can engage the punch member 26A on the sidewall $S_2'$ and apply a force sufficient to bias the sidewall $S_1'$ and clamp surface 80 into engagement with each other in a manner similar to that described above with reference to FIG. 10. Further, it should be noted that an alternative configuration of FIG. 11B can be formed by replacing the ramp structure 78 on the lateral side 39A with a fixed punch member 26B and ramp structure 74, as described with reference to FIG. 8.

It may be noted that although the above description of the alternative configuration illustrated in FIGS. 11A and 11B is provided with specific reference to providing the pallet clamp device for clamping a cart, the clamping device can operate to clamp a variety of articles or load structures supported on the load handling assembly including, without limitation, pallets, carts, pedestrian platforms, storage racks, or other storage structure.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A materials handling vehicle comprising:

a pair of forks to be inserted in a longitudinal direction of the forks into a pallet having one or more stringers; and a pallet clamp device including at least one operating device located in a respective fork for actuating a punch member into engagement with an adjacent surface on the pallet;

wherein the at least one operating device actuates the punch member in substantially linear movement transverse to the longitudinal direction of the forks; and wherein the at least one operating device comprises a module including an actuator, the punch member, and a linkage structure connecting the actuator and the punch member, and including first and second pivot connections, wherein the actuator is located between the first and second pivot and is pivotally attached to the respective fork via the first and second pivot connections, wherein at least one of the first and second pivot connections defines a pivot axis that is transverse to the longitudinal direction.

2. The materials handling vehicle as set forth in claim 1, wherein the at least one operating device is located within a cavity of the respective fork.

3. The materials handling vehicle as set forth in claim 2, wherein the respective fork includes a pair of lateral sides extending in the longitudinal direction, and the at least one operating device is positioned between the lateral sides of the respective fork.

4. The materials handling vehicle as set forth in claim 3, wherein the respective fork includes a guide surface located on one of the lateral sides, and the punch member is supported for sliding movement through the guide surface.

5. The materials handling vehicle as set forth in claim 3, wherein the respective fork includes upper and lower sides extending in the longitudinal direction, and the at least one operating device is positioned between the upper and lower sides of the respective fork.

6. The materials handling vehicle as set forth in claim 1, wherein the punch member is actuated to move toward the other one of the pair of forks for engagement with a stringer of the pallet located between the forks.

7. The materials handling vehicle as set forth in claim 1, wherein the punch member is actuated to move away from the other one of the pair of forks for engagement with a stringer of the pallet located adjacent to an outer side of the respective fork.

8. The materials handling vehicle as set forth in claim 1, wherein the linkage structure comprises a first link having a first end connected to the respective fork at the second pivot connection and a second end connected to an output shaft of the actuator, and a second link having a first end connected to the first link and a second end connected to the punch member.

9. The materials handling vehicle as set forth in claim 1, wherein the actuator comprises a linear motor.

10. The materials handling vehicle as set forth in claim 9, wherein the actuator is coupled to a controller and provides at least one of a force feedback signal and a position feedback signal to the controller for controlling a force applied by the punch member to the pallet surface and/or a position of the punch member relative to the respective fork.

11. The materials handling vehicle as set forth in claim 1, wherein the punch member comprises an elongated shaft extending through the respective fork, and a punch plate removably positioned on an outer end of the elongated shaft for selectable replacement of the punch plate.

12. The materials handling vehicle as set forth in claim 1, wherein the first pivotal connection is defined at an interior surface within the respective fork, and the actuator includes an output shaft that is pivotally connected to the linkage structure within the respective fork.

13. A materials handling vehicle comprising:

a pair of forks to be inserted in a longitudinal direction of the forks into a pallet having one or more stringers; and a pallet clamp device including first and second operating devices for actuating a respective punch member into engagement with an adjacent surface on the pallet;

wherein each operating device comprises a module located within a cavity in one of the forks, the module including an actuator, one of the respective punch members, and a linkage structure connecting the actuator and the respective punch member, and including first and second pivot connections, wherein the actuator is located between the first and second pivot connections and is pivotally attached to the respective fork via the first and second pivot connections, wherein at least one of the first and second pivot connections defines a pivot axis that is transverse to the longitudinal direction.

14. The materials handling vehicle as set forth in claim 13, wherein the second pivot connection defines a pivot attachment between the linkage structure and the respective fork.

15. The materials handling vehicle as set forth in claim 13, wherein the linkage structure comprises a first link having a first end connected to a respective fork at the first pivot connection and a second end connected to an output shaft of the actuator, and a second link having a first end connected to the first link and a second end connected to the punch member.

16. The materials handling vehicle as set forth in claim 15, wherein the actuator comprises a linear motor.

17. The materials handling vehicle as set forth in claim 13, wherein each punch member comprises an elongated shaft extending through a respective fork, and a punch plate removably positioned on an outer end of the elongated shaft for selectable replacement of the punch plate.

18. The materials handling vehicle as set forth in claim 13, wherein the operating devices actuate the punch members in substantially linear movement transverse to the longitudinal direction of the forks.

19. The materials handling vehicle as set forth in claim 13, wherein each actuator is coupled to a controller and provides a force feedback signal and/or a position feedback signal to the controller for controlling a force applied by the punch member to the pallet surface.

20. A materials handling vehicle comprising:

a pair of forks to be inserted in a longitudinal direction of the forks into a pallet having one or more stringers; and a pallet clamp device including first and second operating devices, one mounted in each fork for actuating respective punch members into engagement with an adjacent surface on the pallet;

wherein the operating devices actuate the respective punch members in substantially linear movement transverse to the longitudinal direction of the forks; and wherein the first and second operating devices each comprise a module including an actuator, the punch member, and a linkage structure connecting the actuator and the punch member, and including first and second pivot connections, wherein the actuator is located between the first and second pivot connections and is pivotally attached to the respective fork via the first and second pivot connections, wherein at least one of the first and second pivot connections defines a pivot axis that is transverse to the longitudinal direction.

21. The materials handling vehicle as set forth in claim 20, wherein the punch members are actuated to move toward each other for engagement with a stringer of the pallet located between the forks.

22. The materials handling vehicle as set forth in claim 20, wherein the punch members are actuated to move away from each other for engagement with respective stringers of the pallet located adjacent outer sides of the forks.

23. The materials handling vehicle as set forth in claim 20, wherein each actuator is coupled to a controller and provides at least one of a force feedback signal and a position feedback signal to the controller for controlling a force applied by a respective punch member to the pallet surface and/or a position of a respective punch member relative to a respective fork.

24. The materials handling vehicle as set forth in claim 23, wherein each actuator comprises a linear motor.

25. A materials handling vehicle comprising:

a load handling assembly to be inserted in a longitudinal direction of the load handling assembly into a load structure having longitudinally extending load structure surfaces; and a pallet clamp device including at least one operating device located in the load handling assembly for actuating a punch member into engagement with at least one of the load structure surfaces;

wherein the operating device comprises a module located within a cavity in the load handling assembly, the module including a linear actuator, the punch member, and a linkage structure connecting the actuator and the punch member, and including first and second pivot connections, wherein the actuator is located between the first and second pivot connections and is pivotally attached to the respective fork via the first and second pivot connections.

26. The materials handling vehicle as set forth in claim 25, including a second operating device comprising a module located within the cavity in the load handling assembly, the second module actuating a second punch member into engagement with another one of the load structure surfaces.

27. The materials handling vehicle as set forth in claim 25, wherein the load handling assembly includes a ramp structure extending in a direction away from the punch member for engagement with another one of the load structure surfaces.

* * * * *